US010441005B2

(12) United States Patent
Albanese

(10) Patent No.: US 10,441,005 B2
(45) Date of Patent: Oct. 15, 2019

(54) YOGA PANTS

(71) Applicant: Louis Nicholas Albanese, Effort, PA (US)

(72) Inventor: Louis Nicholas Albanese, Effort, PA (US)

( * ) Notice: Subject to any disclaimer, the term of this patent is extended or adjusted under 35 U.S.C. 154(b) by 72 days.

(21) Appl. No.: 15/664,408

(22) Filed: Jul. 31, 2017

(65) Prior Publication Data

US 2018/0132544 A1 May 17, 2018

Related U.S. Application Data

(60) Provisional application No. 62/420,599, filed on Nov. 11, 2016.

(51) Int. Cl.

| | |
|---|---|
| ***A41D 1/08*** | (2018.01) |
| ***A41D 27/00*** | (2006.01) |
| ***A41D 13/00*** | (2006.01) |
| *A41B 11/14* | (2006.01) |

(52) U.S. Cl.

CPC ..... *A41D 1/08* (2013.01); *A41D 13/0015* (2013.01); *A41D 27/00* (2013.01); *A41B 11/14* (2013.01)

(58) Field of Classification Search

CPC ..... A41D 1/08; A41D 13/0015; A63B 21/04; A63B 21/0428; A63B 21/065; A63B 21/4011

USPC ..... 2/227

See application file for complete search history.

(56) References Cited

U.S. PATENT DOCUMENTS

| | | | | |
|---|---|---|---|---|
| 5,799,328 A * | 9/1998 | Harlem | A41D 13/1236 2/114 |
| 6,167,572 B1 * | 1/2001 | Naumovitz | A41D 1/06 2/227 |
| 8,656,516 B1 * | 2/2014 | Reinhardt Rawlings | A41D 11/00 2/69 |
| 9,456,641 B1 * | 10/2016 | Mignone | A41D 13/0015 |

* cited by examiner

*Primary Examiner* — Katherine M Moran

(74) *Attorney, Agent, or Firm* — Dunlap Bennett & Ludwig PLLC

(57) ABSTRACT

A pair of pants made of a stretchable elastic form fitting material. The pants include a waist band, a first leg sleeve and a second leg sleeves. The first and second leg sleeves extend downward from the waist band. The present invention further includes a strap. The strap may include a first end and a second end each attached to an outer surface of the first leg sleeve below a knee portion. A loop is formed in between the strap and the first leg sleeve. A user may grasp the strap to help with stretching.

10 Claims, 4 Drawing Sheets

YOGA PANTS

CROSS-REFERENCE TO RELATED APPLICATION

This application claims the benefit of priority of U.S. provisional application No. 62/420,599, filed Nov. 11, 2016, the contents of which are herein incorporated by reference.

BACKGROUND OF THE INVENTION

The present invention relates to yoga pants and, more particularly, to yoga pants with horizontally disposed straps.

Yoga is a group of physical, mental, and spiritual practices or disciplines. Yoga is considered an exercise regimen and typically involves stretching and posing. Many beginners to Yoga often have difficulty stretching and extending to the poses.

As can be seen, there is a need for a pair of pants that helps with stretching.

SUMMARY OF THE INVENTION

In one aspect of the present invention, an apparel comprises: a pair of pants made of a stretchable elastic form fitting material and comprising: a waist band; a first leg sleeve extending downward from the waist band; and a second leg sleeve extending downward from the waist band; and at least one first strap comprising a first end and a second end each attached to an outer surface of the first leg sleeve below a knee portion, wherein a loop is formed in between the at least one first strap and the first leg sleeve.

These and other features, aspects and advantages of the present invention will become better understood with reference to the following drawings, description and claims.

DETAILED DESCRIPTION OF THE INVENTION

Figure 1:
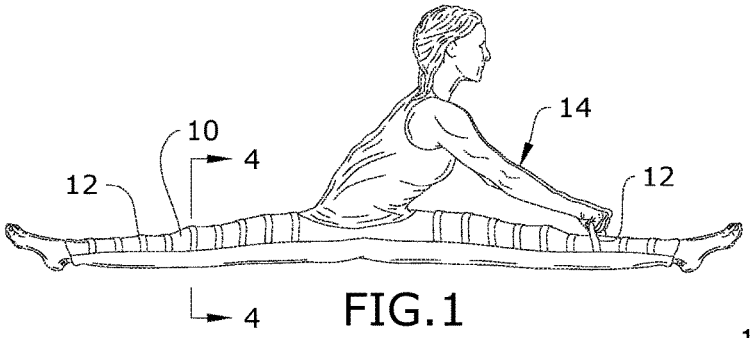
FIG. 1 is a front view of an embodiment of the present invention in use.
Figure 3:
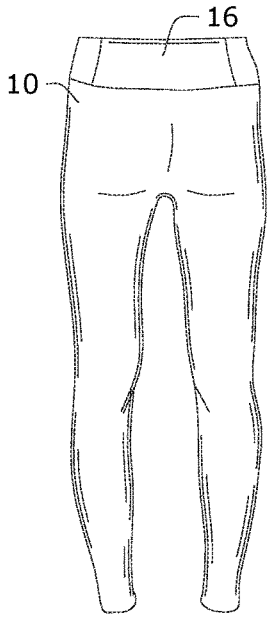
FIG. 3 is a rear view of an embodiment of the present invention.
Figure 2:
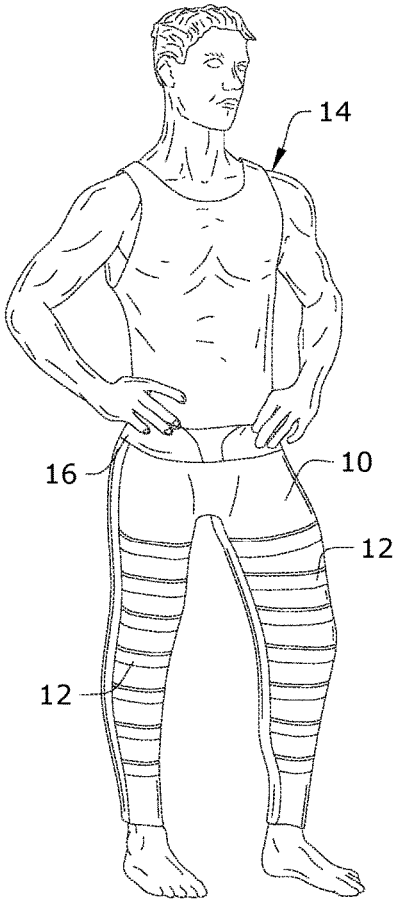
FIG. 2 is a front view of an embodiment of the present invention in use.
Figure 4:
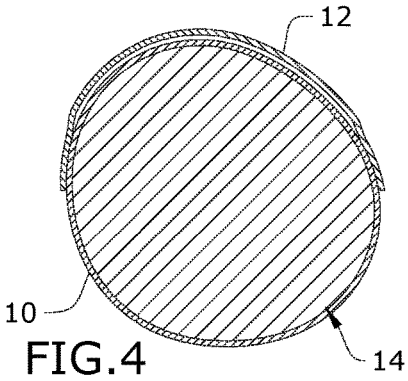
FIG. 4 is a section view of the present invention taken along line 4-4 in FIG. 1.
Figure 5:
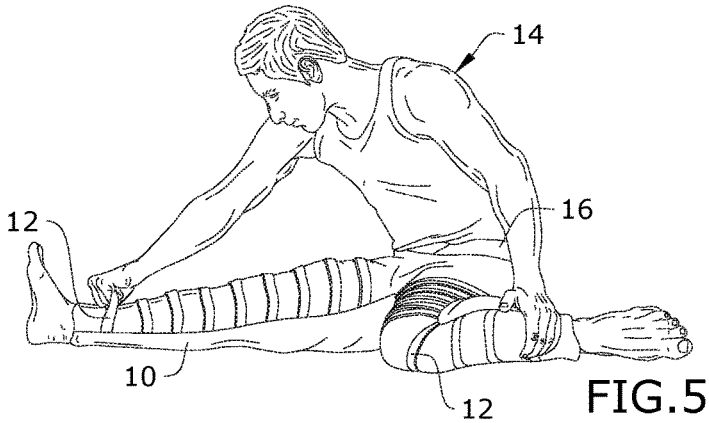
FIG. 5 is a perspective view of an embodiment of the present invention in use.
Figure 6:
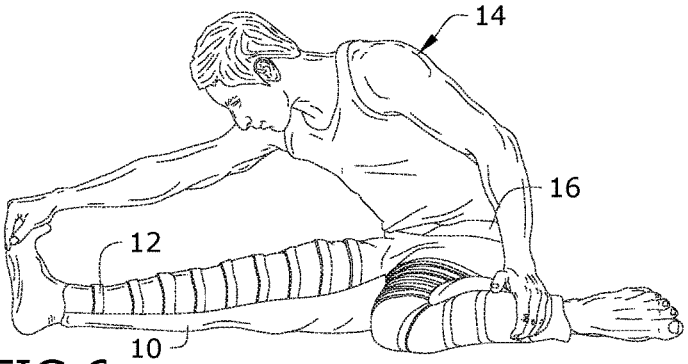
FIG. 6 is a perspective view of an embodiment of the present invention in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a type of yoga pants which assists the user in stretching. The present invention assists the user in stretching by allowing them to incrementally adjust how far they stretch as they progress. The addition of horizontal bands on the legs of the yoga pants allows for the user to grab different lengths away from their body to gradually build up flexibility.

Referring to FIGS. 1 through 20, the present invention includes an apparel. The apparel includes a pair of pants 10 made of a stretchable elastic form fitting material. The pants 10 include a waist band 16, a first leg sleeve and a second leg sleeve. The first and second leg sleeves extend downward from the waist band 16. The present invention further includes a strap 12. The strap 12 may include a first end and a second end each attached to an outer surface of the first leg sleeve below a knee portion. A loop is formed in between the strap 12 and the first leg sleeve. A user 14 may grasp the strap 12 to help with stretching.

The strap 12 may include a plurality of first straps and a plurality of second straps 12. The straps 12 may be made of an elastic stretchable material similar to the pants 10. As illustrated in FIGS. 1 through 6, the plurality of first straps 12 may attached to the first leg sleeve and may be disposed horizontally and substantially parallel relative to one another. The plurality of second straps 12 may be attached to the second leg sleeve and may be disposed horizontally and substantially parallel relative to one another. Each of the first and second plurality of straps 12 may be disposed along the length of the pants 10 from an ankle portion of the leg sleeves all the way up to just below a crotch portion of the pants 10.

Figure 9:
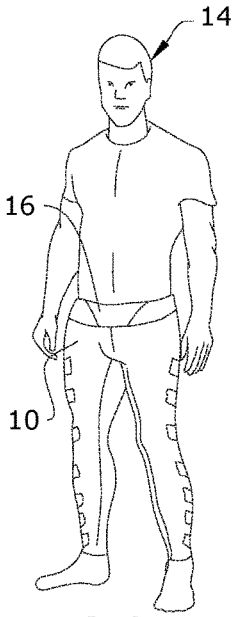
FIG. 9 is a front view of an embodiment of the present invention in use.
Figure 10:
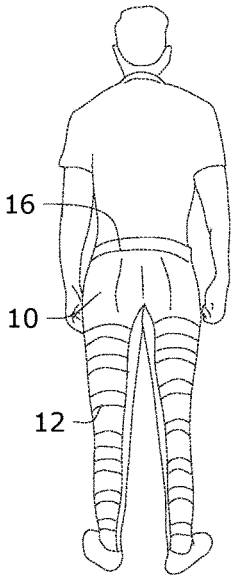
FIG. 10 is a rear view of an embodiment of the present invention in use.

As illustrated in FIGS. 1 through 6, the plurality of first straps 12 and the plurality of second straps 12 are disposed on a front surface of the first and second leg sleeves respectively. As illustrated in FIGS. 9 and 10, the plurality of first straps 12 and the plurality of second straps 12 are disposed on a rear surface of the first and second leg sleeve respectively. In certain embodiments, the straps 12 are disposed on the front and rear surface of the pant legs.

As illustrated in FIGS. 7, 8, 11 and 12, the present invention may include a plurality of pairs of first straps 12 attached to the outer surface of the first leg sleeve and disposed above and believe one another. Each pair is two crossing straps 12. Further, the present invention includes a plurality of pairs of second straps 12 attached to the outer surface of the second sleeve disposed above and below one another. Each of the pair is two crossing straps 12.

Figure 7:
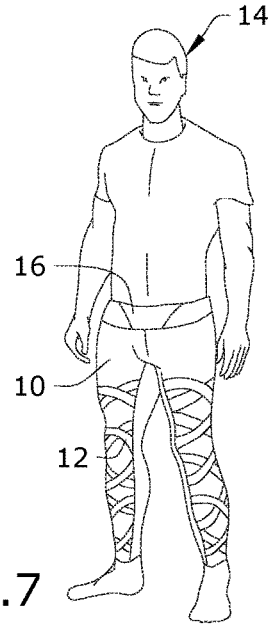
FIG. 7 is a front view of an embodiment of the present invention in use.
Figure 8:
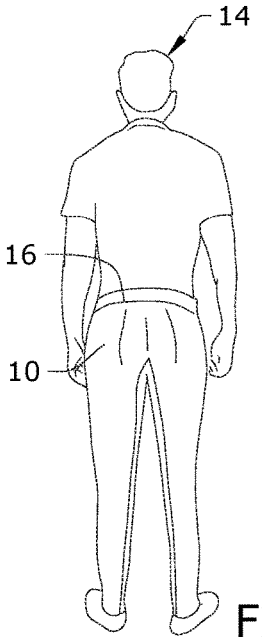
FIG. 8 is a rear view of an embodiment of the present invention in use.
Figure 11:
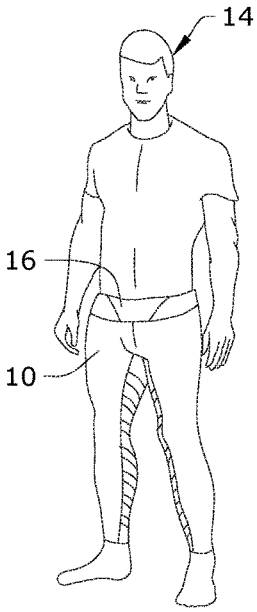
FIG. 11 is a front view of an embodiment of the present invention in use.
Figure 12:
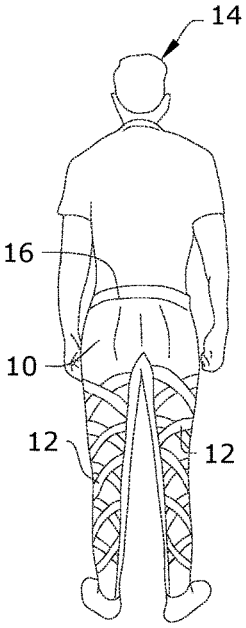
FIG. 12 is a rear view of an embodiment of the present invention in use.
Figure 13:
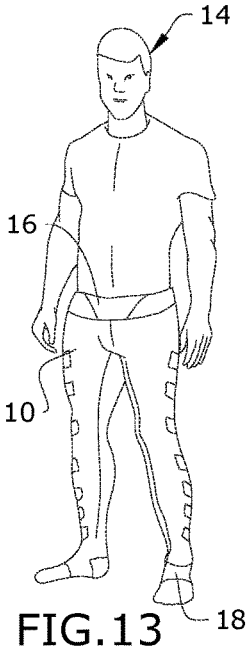
FIG. 13 is a front view of an embodiment of the present invention in use.
Figure 14:
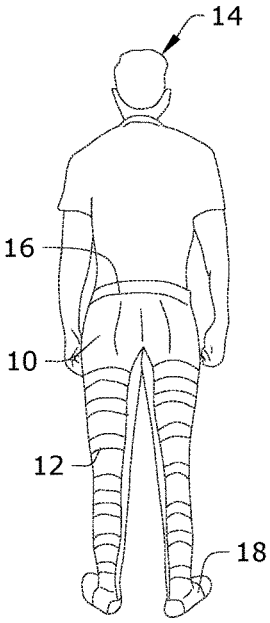
FIG. 14 is a rear view of an embodiment of the present invention in use.
Figure 15:
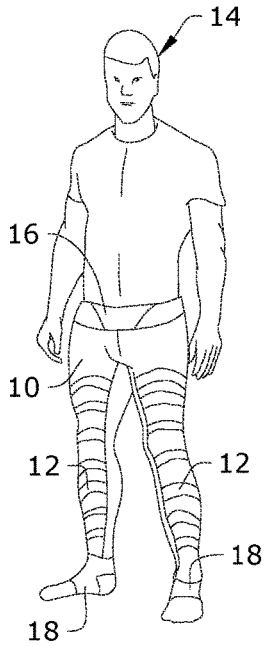
FIG. 15 is a front view of an embodiment of the present invention in use.
Figure 16:
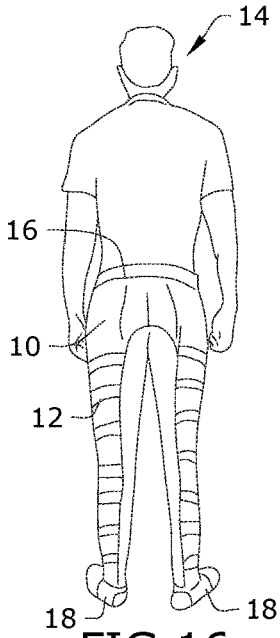
FIG. 16 is a rear view of an embodiment of the present invention in use.
Figure 17:
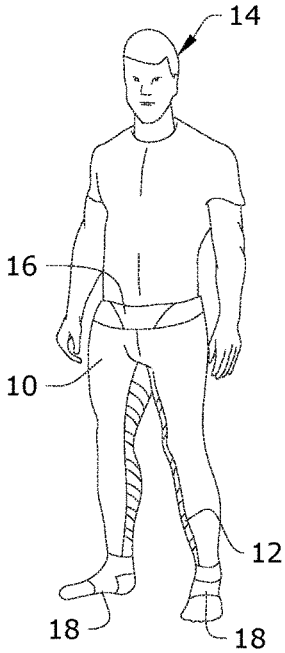
FIG. 17 is a front view of an embodiment of the present invention in use.
Figure 18:
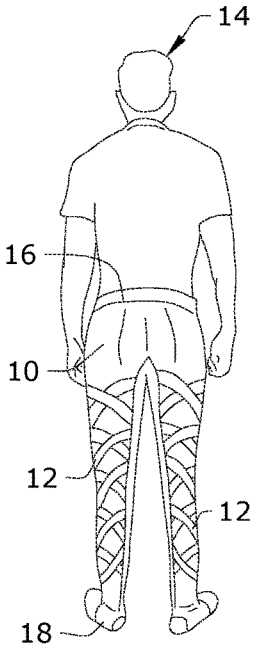
FIG. 18 is a rear view of an embodiment of the present invention in use.
Figure 19:
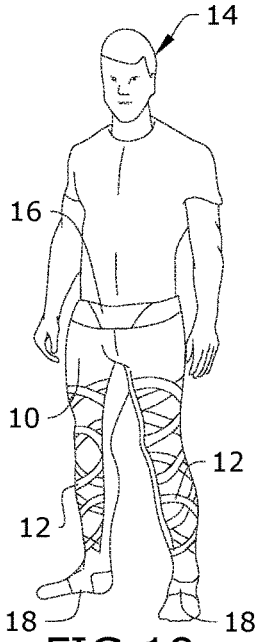
FIG. 19 is a front view of an embodiment of the present invention in use.
Figure 20:
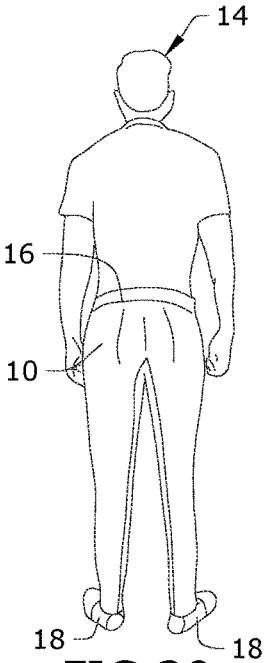
FIG. 20 is a rear view of an embodiment of the present invention in use.

As illustrated in FIGS. 7 and 8, the plurality of pairs of first straps 12 and the plurality of pairs of second straps 12 are disposed on a front surface of the first and second leg sleeve respectively. As illustrated in FIGS. 11 and 12, the plurality of pairs of first straps 12 and the plurality of pairs of second straps 12 are disposed on a rear surface of the first and second leg sleeve respectively. In certain embodiments, the straps 12 are disposed on the front and rear surface of the pant legs.

As illustrated in FIGS. 13 through 20, each of the embodiments mentioned above may include stirrups 18. The stirrups 18 include a first looped band extending from a bottom edge of the first leg sleeve and a second looped band extending from a bottom edge of the second leg sleeve. The stirrups 18 wrap around a user's foot and prevents the user 14 from pulling the pant legs upward while performing the stretches.

The yoga pants may be manufactured utilizing a blend of spandex, cotton, polyester, and other clothing material. The horizontal straps on the yoga pants may be sewn onto the legs and may be made of elastic materials such that the user could grab onto the straps and pull themselves down for flexibility improvement. A waist band may be made of a spandex blend with an elastic band inside the waist. The cuffs of the yoga pants may also be made of spandex blend and include an adjustable Velcro® strap to tighten the bottom of the pant leg. Tightening of the pant leg prevents the pant leg from riding up when the consumer is utilizing the flexibility straps on the pants.

The present invention assists the individual in gaining flexibility in increments by utilizing the flexibility straps at different distances. For example, if someone is new to yoga and has a difficult time extending their legs and reaching out to their toes they could start by grabbing the flexibility band closest to them on the pants and pulling their spine down into proper alignment. As they become more comfortable with this procedure, they can move to further and further flexibility bands allowing for a greater reach and stretch, thus increasing flexibility at one's own pace.

It should be understood, of course, that the foregoing relates to exemplary embodiments of the invention and that modifications may be made without departing from the spirit and scope of the invention as set forth in the following claims.

What is claimed is:

1. An apparel comprising:

a pair of pants made of a stretchable elastic form fitting material and comprising:

a waist band;

a first leg sleeve extending downward from the waist band; and a second leg sleeve extending downward from the waist band; and at least one first strap comprising a first end and a second end each attached to an outer surface of the first leg sleeve below a knee portion, wherein the at least one first strap is disposed on one of a front surface and a rear surface of the first leg sleeve, wherein a loop is formed in between the at least one first strap and the first leg sleeve.

2. The apparel of claim 1, further comprising at least one second strap comprising a first end and a second end each attached to an outer surface of the second leg sleeve below a knee portion, wherein a loop is formed in between the at least one second strap and the second leg sleeve.

3. The apparel of claim 2, wherein the at least one first strap is a plurality of first straps disposed above and below one another and each disposed horizontally.

4. The apparel of claim 3, wherein the at least one second strap is a plurality of second straps disposed above and below one another and each disposed horizontally.

5. The apparel of claim 4, wherein the plurality of first straps and the plurality of second straps are disposed on the front surface of the first leg sleeve and a front surface of the second leg sleeve respectively.

6. The apparel of claim 4, wherein the plurality of first straps and the plurality of second straps are disposed on the rear surface of the first leg sleeve and a rear surface of the second leg sleeve respectively.

7. The apparel of claim 2, wherein the at least one first strap is a plurality of pairs of first straps disposed above and below one another, wherein each pair is two crossing straps.

8. The apparel of claim 7, wherein the at least one second strap is a plurality of pairs of second straps disposed above and below one another, wherein each pair is two crossing straps.

9. The apparel of claim 8, wherein the plurality of pairs of first straps and the plurality of pairs of second straps are disposed on the front surface of the first leg sleeve and a rear surface of the second leg sleeve respectively.

10. The apparel of claim 8, wherein the plurality of pairs of first straps and the plurality of pairs of second straps are disposed on the rear surface of the first leg sleeve and a rear surface of the second leg sleeve respectively.

* * * * *